United States Patent [19]

Luther et al.

[11] Patent Number: 4,643,099

[45] Date of Patent: Feb. 17, 1987

[54] ARMORED-PIERCING PROJECTILE (PENETRATOR)

[75] Inventors: Hans-Werner Luther, Kaarst; Udo Sabranski, Willich, both of Fed. Rep. of Germany

[73] Assignee: Rheinmetall GmbH, Duesseldorf, Fed. Rep. of Germany

[21] Appl. No.: 753,655

[22] Filed: Jul. 10, 1985

Related U.S. Application Data

[63] Continuation-in-part of Ser. No. 625,457, Jun. 28, 1984, abandoned, which is a continuation-in-part of Ser. No. 308,200, Sep. 24, 1981, abandoned.

[30] Foreign Application Priority Data

Oct. 4, 1980 [DE] Fed. Rep. of Germany ..... 3037560

[51] Int. Cl.[4] ..... F42B 11/00

[52] U.S. Cl. ..... 102/517; 102/521

[58] Field of Search ..... 102/501, 517–523

[56] References Cited

U.S. PATENT DOCUMENTS

| | | | |
|---|---|---|---|
| 3,213,792 | 10/1965 | Grenander et al. | 102/518 |
| 3,370,535 | 2/1968 | Permutter | 102/518 |
| 3,620,167 | 11/1971 | Romer et al. | 102/521 |
| 3,979,234 | 9/1976 | Northcutt, Jr. et al. | 419/28 |
| 4,075,946 | 2/1978 | Deffayet et al. | 102/518 |
| 4,284,008 | 8/1981 | Kerkendall et al. | 102/521 |
| 4,353,305 | 10/1982 | Moreau | 102/519 |

FOREIGN PATENT DOCUMENTS

| | | | |
|---|---|---|---|
| 41147 | 12/1932 | France | 102/520 |

*Primary Examiner*—Harold J. Tudor

[57] ABSTRACT

An improved armor-piercing penetrator projectile includes a core made of a material having a high tungsten content which is in metallic form. The front portion of the core is in the shape of a hemisphere and includes a nose point in the form of a ballistic hood. The core extends or occupies the entire cross-section of the projectile and has a high length/diameter-relationship. The hemispherical front portion of the core is adapted to directly contact a target upon impact of the projectile.

3 Claims, 2 Drawing Figures

ARMORED-PIERCING PROJECTILE (PENETRATOR)

CROSS-REFERENCE TO RELATED APPLICATION

This application is a continuation-in-part application of our copending application Ser. No. 625,457, filed on June 28, 1984, which is in turn a continuation-in-part application of our application Ser. No. 308,200, filed on Sept. 24, 1981, both abandoned.

BACKGROUND OF THE INVENTION

The projectile of this invention is of the type described in German published application No. DE-PS 1,194,292 and U.S. Pat. No. 3,213,792 (assigned to Aktiebolaget Bofors, Bofors, Sweden). Such projectile consists of a housing which is sealed at its front and which includes a projectile core, preferably of tungsten carbide, which is enclosed by the housing and which bears against a heavy metal core support mounted in the nose of the projectile. The front portion of the projectile core is a hemisphere which is slidably movably arranged in a substantially conical shaped recess of the heavy metal core support which is mounted in the nose of the projectile. The housing is provided on its periphery with fracture zones formed by one or more grooves which are disposed in transverse positions between the nose and the cylindrical core of the projectile. The configuration of the heavy metal core support which is mounted in the nose of the projectile, has a frusto-conical exterior periphery, which is defined by an acute angle of less than 35 degrees. It is asserted that this known armor-piercing penetrator projectile has an improved armor-piercing effect, in particular when impacting on an inclined armor plate target. It is further asserted that this projectile impacts the armor plate not only with the forward portion of the outer housing but also with the forward portion of the heavy metal core support. It is further asserted that the latter thereby receives a rotating moment about its center of gravity, which is propagated in the direction of the armor plate and which, due to the arrangement of the forward portion of the core, is transferred thereto. Upon impact therefore the forward portion of the core is to be rotated in the direction of the armor plate, so that thereby a shorter path of penetration through the armor plate results.

This known armor-piercing projectile has the following drawbacks:

Due to the construction of the jacket, the average density of the projectile which should be as high as possible, is substantially reduced; the tungsten carbide due to its brittleness does not attain an effective application against the more recently developed modern multiplate targets which are being used with increased frequency; in view of the reduced length/diameter-relationship the specific surface load, which surface loading is quite significant, in connection with the penetration capacity can only be slightly improved.

SUMMARY OF THE INVENTION

It is an object of this invention to provide an armor-piercing projectile of the afore-described type which has a high probability of effectiveness against multiple targets.

The armor-piercing projectile of this invention, in contradistinction to the armor-piercing projectile disclosed in the afore-mentioned German patent No. DE-PS 1,194,292 and U.S. Pat. No. 3,213,792, has a hemispherical projectile nose which is covered only by a thin-walled ballistic hood, so that not only aerodynamically favorable conditions are maintained, but also the direct contacting of the hemispherical forward nose portion of the projectile with the target is substantially ensured.

In view of its large length/diameter-relationship (at least 12) the projectile of the invention would be subjected to a presumptively forced rotational movement upon impact which is considered to inhibit the penetration capacity thereof because: unavoidable, large lateral forces could lead to a breakup of the penetrator; the penetrator would be deflected from its flight path and, after the formation of a penetration channel in the region of the pre-armor, would be exposed in that region to its destruction due to impact-bending loads, so that a substantial portion of its mass is no longer available for the further penetration demand. All of these drawbacks are either eliminated or mitigated with the novel projectile construction of this invention.

BRIEF DESCRIPTION OF THE DRAWING

With these and other objects in view, which will become apparent in the following detailed description, the present invention, which is shown by example, will be clearly understood in connection with the accompanying drawings, in which.

DETAILED DESCRIPTION

Figure 1:
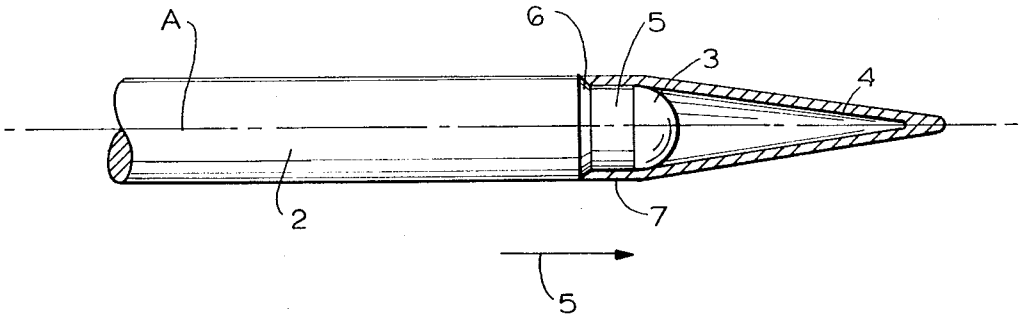
FIG. 1 is a longitudinal axial view, partially in section, of the forward region of the projectile in accordance with the invention.

The projectile is constructed as a sub-caliber projectile having a core 2 and a large length/diameter relationship and is made of a known sintered compound material having a particularly high metal tungsten content which is in metallic form. For example, tungsten alloys of the type described in U.S. Pat. No. 3,979,234 are suitable for use in the projectile of this invention. A suitable composition for such an alloy is, for example, 93 wt.% tungsten, 4.55 wt.% nickel, 2.45 wt.% iron. Its physical and mechanical property values are: RM at least 12N/mm$^2$ (tensile strength), A5 at least 4% (elasticity, coefficient of elongation), hardness at least 40 HRc (Rockwell hardness) according to density 17.5 gm/cm$^3$ ASTM E18 (ASTM means AMERICAN SOCIETY FOR TESTING MATERIALS).

The composition of tungsten alloys set forth in U.S. Pat. No. 3,979,234 are herewith incorporated by reference. The densities of the tungsten alloys which are suitable for the projectile of this invention are at least 15.63 grams/cm$^3$ (see for example column 6 of U.S. Pat. No. 3,979,234). The forward end of the core is formed as a hemisphere 3, which extends rearwardly in the form of cylindrical portion 5 of smaller diameter than the remainder of the projectile up to a step 6. A thin-walled ballistic hood 4 encompasses with its rear-sided cylindrical part 7 the cylindrical part 5 and bears against the step-surface 6. The ballistic hood 4 (which is in the shape of a point-nose) can also in this case be connected in a conventional manner not further described with the core 2.

The projectile 1 having a longitudinal axis A moves in the direction of the arrow S and impacts on a non-illustrated target. In view of the fact that the hood 4 is thin-walled the surface of the hemisphere 3 essentially directly impacts on the surface of the target. The locus of the mutual contacting approximates a point contact. Thereby there results an extraordinary high specific surface load (advantageously even with a very small impact angle) which substantially presupposes a high penetration capacity.

Figure 2:
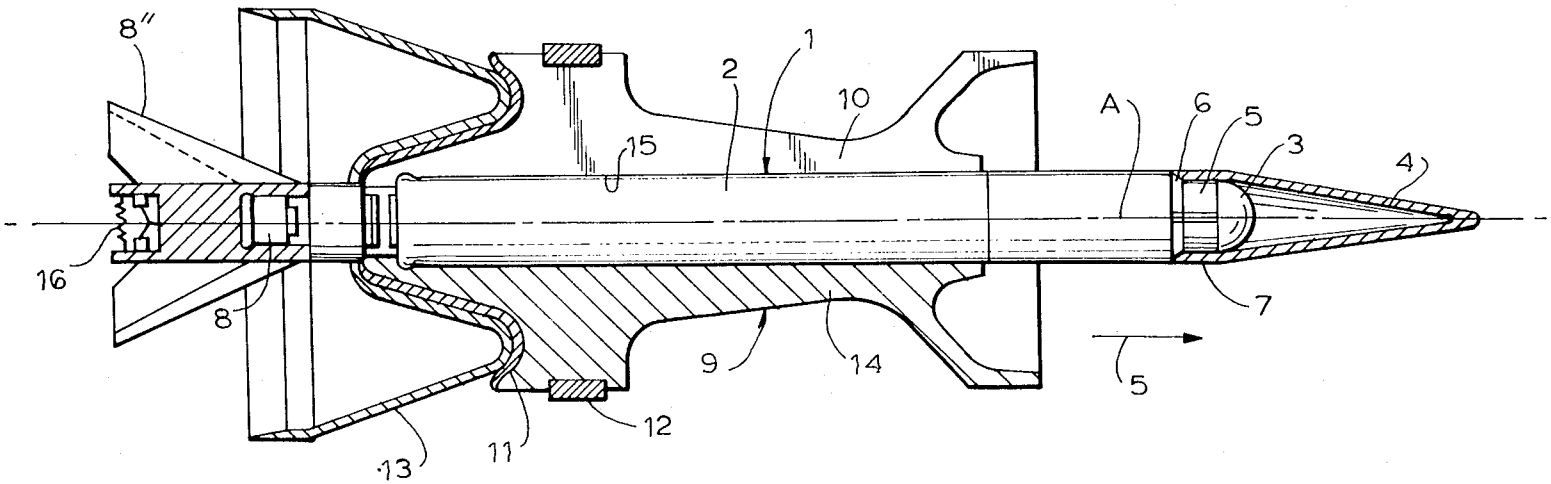
FIG. 2 is a longitudinal axial cross-section through the entire projectile of FIG. 1 also illustrating the front portion of the cartridge case and a sabot mounted thereon.

There is illustrated in FIG. 2 an entire projectile assembly having the same reference numbers as in FIG. 1. A sabot having sabot segments 10 is coaxially mounted on the core 2. The aft portion 8 of the projectile has a plurality of equidistant stabilizing fins 8. The segments 9 are held in assembly by the sealing element 11 and driving band 12. The front portion 13 of the cartridge case acts as a connecting element. The form-locking means 14, 15 serve to connect the sabot segments 10 to the core 2. A tracer composition 16 may be mounted in the tail end of the projectile. The form-locking means may be in the form of an internal and mating external thread which form a threaded connection.

The ballistic hood 4 is thin-walled and made of "automatic steel" (9SMn28) and is press-fitted on the core 2 at the region 5 (FIG. 1).

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An improved armor-piercing projectile having a target-effective core occupying the entire cross-section of said projectile and being made of a material having a density of at least 15.63 g, $cm^{-}$, the front portion of said core being in the shape of a hemisphere, said hemisphere being covered by a ballistic hood forming a nose point of said projectile, the improvement comprising said core being in sub-caliber shape and having a length/diameter-relationship of at least 12 and being made of a material with a high metal tungsten alloy content of at least 90 weight percent of tungsten, on the outer surface of said core at least being partially provided with means to formlockingly interact with corresponding means of a sabot being segmented for discarding after having passed the muzzle of a barrel, the aft portion of said core having stabilizing fins connected thereto, said ballistic hood, so as not to hinder a point contact between the hemisphere and a target, is made of a suitable and thin-walled material and is mounted on said core so as to detach upon impact on the target of said projectile; and said hemisphere and ballistic hood defining an empty chamber therebetween so that said ballistic hood can detach upon impact on a target thereby ensuring direct contact between the hemispherically shaped front portion of the projectile and the surface of the target.

2. Projectile according to claim 1, wherein said tungsten of the material is sintered in the presence of a liquid phase, consisting of iron and nickel.

3. Projectile according to claim 2, wherein said hood is press-fitted to said core.

* * * * *